United States Patent [19]

Buck

[11] 4,266,761

[45] May 12, 1981

[54] APPARATUS FOR PLACING TERMINAL SHEETS OR THE LIKE ON TO LAYERS OF SHEETS

[75] Inventor: Hermann Buck, Huelben, Fed. Rep. of Germany

[73] Assignee: Bielomatick Leuze GmbH & Co., Fed. Rep. of Germany

[21] Appl. No.: 974,289

[22] Filed: Dec. 29, 1978

[30] Foreign Application Priority Data

Jan. 10, 1978 [DE] Fed. Rep. of Germany ..... 2800846

[51] Int. Cl.[3] ..... B65H 39/055; B65H 39/075

[52] U.S. Cl. ..... 270/58

[58] Field of Search ..... 270/54, 55, 57, 58, 270/59; 414/95; 271/212

[56] References Cited

U.S. PATENT DOCUMENTS

| | | | |
|---|---|---|---|
| 3,205,739 | 9/1965 | Meyer-Jagenberg | 270/58 |
| 3,887,176 | 6/1975 | Paulus | 270/58 |
| 3,901,500 | 8/1975 | Gath | 270/58 |
| 3,979,112 | 9/1976 | Munn | 270/58 |

FOREIGN PATENT DOCUMENTS

| | | | |
|---|---|---|---|
| 613771 | 3/1935 | Fed. Rep. of Germany | 271/212 |

*Primary Examiner*—Edgar S. Burr
*Assistant Examiner*—A. Heinz
*Attorney, Agent, or Firm*—Steele, Gould & Fried

[57] ABSTRACT

An apparatus is provided for placing end sheets or the like under a stack of sheets. The apparatus has a conveying arrangement for conveying the stacked layers of sheets and a feed arrangement for the end sheets. The feed arrangement is designed to place the end sheets at least partially on to the conveying arrangement. A lifting arrangement for lifting the layers of sheets being conveyed on the conveying arrangement is provided upstream of the position at which the end sheets are placed on the conveying arrangement.

7 Claims, 6 Drawing Figures

11
12
13
14
15
16
17
18
19
20
22
23
24
25
26
27
28
29
30
31
32
33

APPARATUS FOR PLACING TERMINAL SHEETS OR THE LIKE ON TO LAYERS OF SHEETS

BACKGROUND OF THE INVENTION

The invention relates to an apparatus for placing end sheets or the like on layers or stacks of sheets, the apparatus having a transporting section for the layers of sheets and an end sheet feed arrangement provided above the layers of sheets.

When producing writing-pads, exercise books or the like on automatic production machines, it is necessary to feed separately the top and bottom end sheets which differ from the rest of the layer of sheets. The top or bottom sheets are usually produced from a thicker material and are usually printed. One of the end sheets, for example the bottom sheet, is normally placed on and the layer of sheets from above. In order to supply the second end sheet, for example the top sheet, it is necessary to turn the layer of sheets with the previously supplied end sheet, through 180°. This is normally performed in a turning star. The end sheet supplied first now lies at the bottom and the second end sheet is supplied from a second feed arrangement. This mode of operation has the disadvantage of requiring a very complex and large turning star and this also impairs the operating reliability, and increases the length of the machine. The turning star cannot be used with great lengths of layers of sheets owing to its structure which is otherwise too large. When the format is changed to this size, it is necessary to use a by-pass in the conventional apparatus, by means of which the turning star may be by-passed. This by-pass demands an additional increase in the length of the machine. In this case, the second end sheet has to be omitted or supplied manually.

BRIEF SUMMARY OF THE INVENTION

The object of the invention is to provide an apparatus of the type mentioned above which allows end sheets to be supplied but which is considerably simplified.

According to the invention there is provided an apparatus for placing an end sheet or the like under a stack of sheets, comprising a conveying arrangement for conveying the stacks of sheets, a feed arrangement for feeding the end sheets so as to place the end sheets at a predetermined position at least partially on to the said conveying arrangement, and a lifting arrangement for lifting the layer of sheets being conveyed on the conveying arrangement, said lifting arrangement being located upstream of the said predetermined position as viewed in the conveying direction.

The invention allows an end sheet to be placed on to the layer of sheets from below so that a turning star can be dispensed with, since a similarly designed placing apparatus can place the second end sheet on to the layer of sheets in a simple manner from above either beforehand or afterwards. This affords the advantages that the apparatus can be produced substantially more simply and with greater operating reliability, that the machine can be shorter and that both end sheets can be placed in position simply even in the case of large formats. Another advantage during operation is that the apparatus can be oriented in such a way that the same page, preferably the upper obverse page, lies uppermost both with the layers of sheets and with the subsequent end sheet, so that this page is always available for intermediate monitoring. With an apparatus using a turning star, this page changes so that either only the obverse page of the layer of sheets or the end sheets can be monitored optically.

The feed arrangement is preferably placed above the transporting arrangements which feeds the end sheets in the conveying direction. This allows apparatuses which are designed substantially identically to be used for placing the upper and lower end sheets. However, it is also possible to feed the end sheets transversely to the conveying direction.

In a preferred embodiment, a stop, which cooperates with the front edge of the end sheet supplied when it is placed on the conveying section, is provided. This stop, which is preferably introduced into a position above the layers of sheets, restricts the movement of the end sheet in the conveying direction so that the end sheet is correctly positioned even when it is supplied at high speed.

It is also preferred to move the lifting apparatus cyclically into and out of engagement with the layers of sheets. For this purpose, the lifting apparatus can have at least one oblique surface which preferably engages through the conveying plane from below. The layer of sheets is thus raised quite definitely at the position at which it runs over the end sheet. It would however also be possible to use a continuously acting lifting arrangement.

In addition, rollers or similar arrangements can be used instead of the oblique surface. An introducible stop can also be provided for the rear edge of the end sheet. This stop similarly contributes to the precise orientation of the end sheet on the conveying apparatus. It can preferably be formed by a part of the lifting apparatus which can be in the form of at least one pivotal lever.

In a preferred embodiment the conveying arrangement comprises conveying members such that the front part of the end sheets can cover the conveying arrangement and optionally a part of the previous layer of sheets. In this way, it is possible to place the end sheets on the conveying sections without the gaps between the individual stacks of sheets having to be larger than the length of the end sheet. This feature therefore contributes to the increase in the efficiency of the apparatus and thus of the entire machine. The transporting members can be claws which are bevelled on their rear edge, by means of which the end sheets can easily be pushed over.

An embodiment of the invention is illustrated in the accompanying drawings and is described in more detail below.

DETAILED DESCRIPTION OF PREFERRED EMBODIMENT

Figures 1, 2:
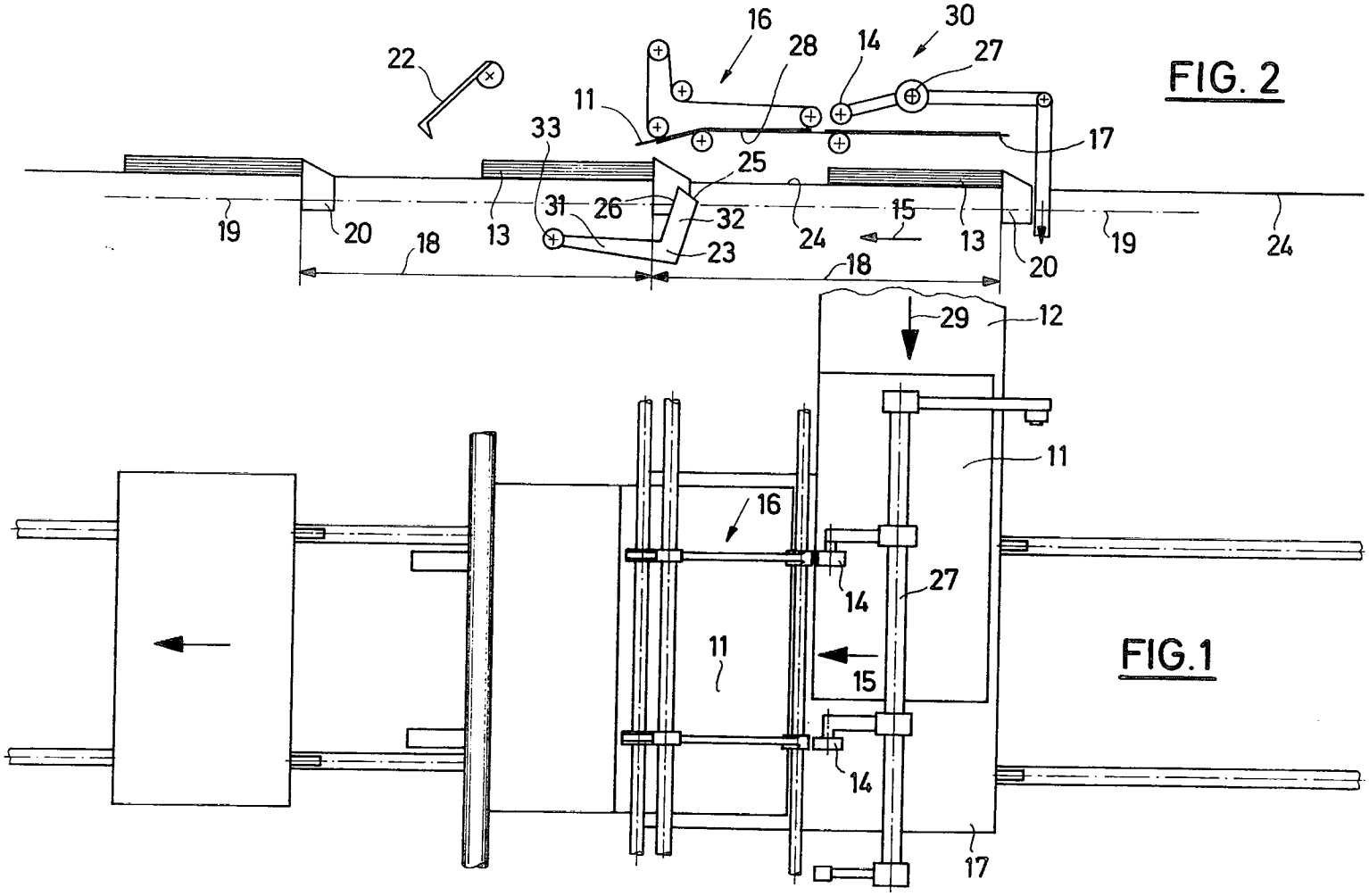
FIG. 1 shows a diagrammatic plan view of an apparatus according to the invention.
FIGS. 2 to 6 show side views of the apparatus according to FIG. 1 in various successive operating positions.

The apparatus illustrated in the drawings is a part of a machine for the production of layers of sheets provided with an end sheet, such as for example, writing pads, and is used for placing one of the end sheets 11 on to the layers of sheets 13.

A conveying section for the layers of sheets 13, consisting of a chain 19, shown only diagrammatically, and claws 20 fixed on it, runs through the apparatus. A feed arrangement 30 for the end sheets 11 is arranged above this conveying section and has a conveying means serving as an applicator for placing the end sheets 11 on to the applicator table 17 in the transverse direction 29 to the conveying direction 15 of the layers of sheets.

Lightly-touching rollers 14 are arranged above the applicator table on a shaft 27 which can be pivoted by a lever mechanism. At a predetermined moment in time, rollers 14 place an end sheet 11 beneath a section of belt 16 which conveys the end sheet in the conveying direction 15. The section of belt and the guide plate 28 located beneath it are designed in such a way that the end sheet 11 leaves the section of belt 16 in a direction pointing obliquely downwards.

A stop 22 is arranged at a distance from the end of the section of belt 16 which is larger than the length of the end sheet in the conveying direction 15. The stop 22 comprises claw-like retaining fingers which can be pivoted by means of a shaft and is arranged in such a way that these retaining fingers, which can also form a support for the front edge of the end sheet, lie closely above the stack of sheets in the pivoted-in position. The claws 20 of the conveying section have a substantially vertical front edge which serves to push the stack of sheets on the conveying plane 24, for example a sliding plate, and have a bevelled rear face.

A lifting mechanism is arranged just before the end of the conveying section or, more precisely, just before the position which the rear edge of the end sheet 11 adopts after it has been placed on to the conveying section, in the conveying direction. This lifting mechanism can be pivoted from the bottom to the top through the conveying plane 24 and takes the form of an element 32 provided on a lever 31, this element having an oblique surface 25 on its front edge and a substantially vertical stop face 26 on its rear edge. The lifting apparatus 23 consists of a plurality, preferably two, levers 31 and elements 32, which are pivoted on a common shaft 33.

The apparatus illustrated in the drawings operates as follows. The bottom end sheets 11 are conveyed individually by the applicator 12 in direction 29 on to the applicator table 17 where they lie, ready to be carried off in direction 15. This is performed by the lightly-touching rollers 14 which are activated in synchronism with the conveying section 19, 20 and which introduce the end sheet 11 between the conveyor belt 16 and the guide plate 28 so that it is conveyed in the conveying direction and ejected above the conveying plane (FIGS. 1 and 2). The lifting apparatus 23 and the stop 22 are pivoted in this position into their inoperative positions.

Figure 3:
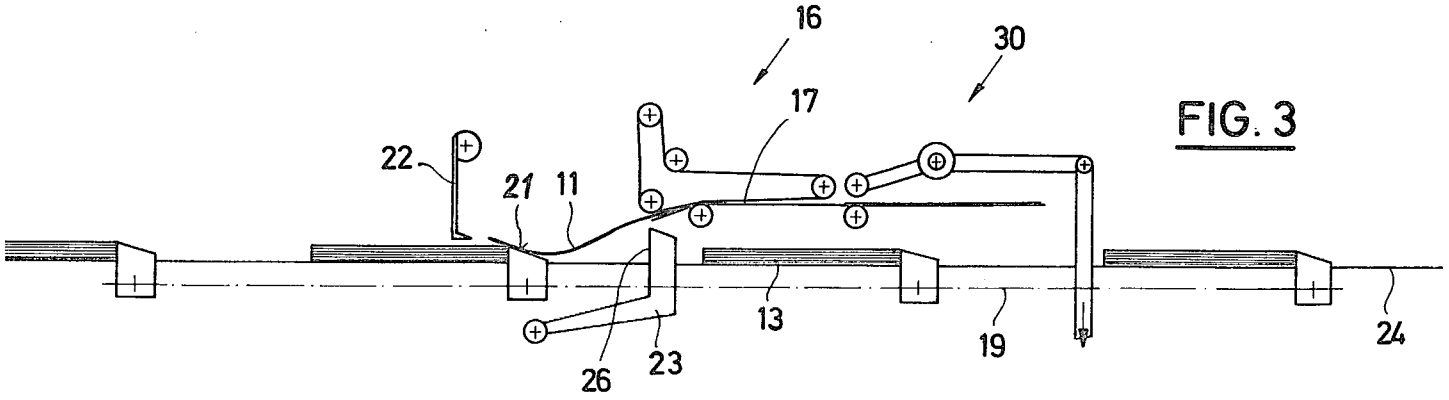

FIG. 3 shows the next operating position, in which the stop 22 is pivoted into its working position and the lifting apparatus 23 is also pivoted upwards through the conveying plane 24 so that its stop face 26 is located in the working position. The end sheet 11 is deposited on the conveying section in such a way that its front part lies on the upstream stack of sheets and the oblique surface 21 of the claws 20. This makes it possible to keep the stationary distance or the division 18 between the individual layers of sheets on the conveying section smaller than twice the length of the layer of sheets including the dimensions of the claws. In other words, the free space on the conveying section between the rear edge of the front claws and the front edge of the subsequent stack of sheets can be smaller than the length of the end sheet 11 in the conveying direction.

The stop 22 forms a front stop and the stop surface 26 forms a rear stop for the front and rear edge of the end sheet 11 which is precisely positioned on the conveying sections in this way so that the end sheet slides back against the conveying direction owing to its oblique position on the oblique surface 21 and then forms a ramp for the next stack of sheets 13. The stop 22 remains in its pivoted position and prevents the end sheet 11 from being entrained on the conveying plane 24.

Figure 4:
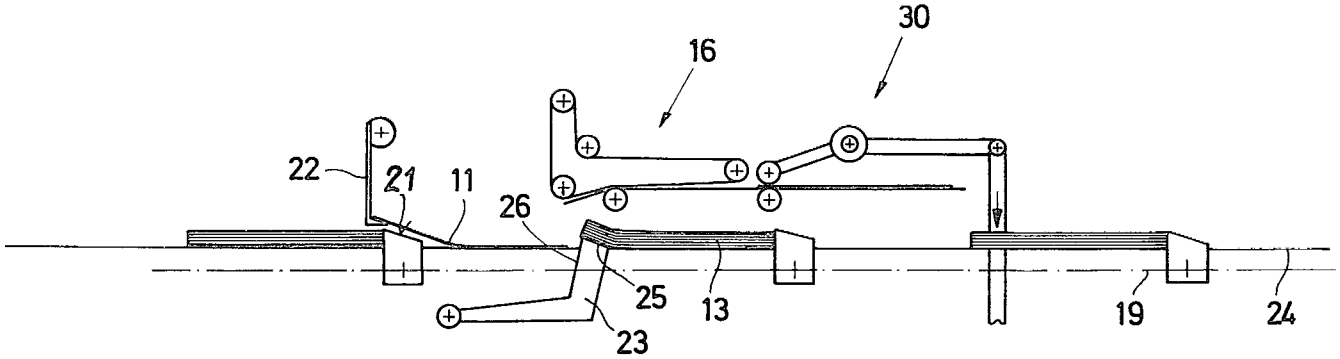

The lifting apparatus 23 is preferably pivoted into its uppermost position in FIG. 3 so that the stop surface 26 projects relatively highly above the plane 24. In FIG. 4, it is lowered somewhat so that the oblique surface 25 forms a ramp for the stack of sheets.

Figure 5:
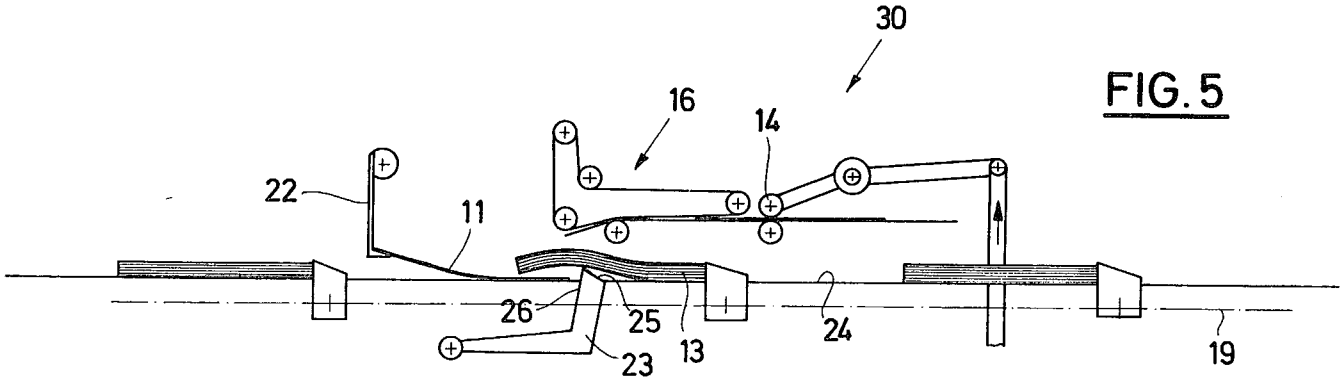
Figure 6:
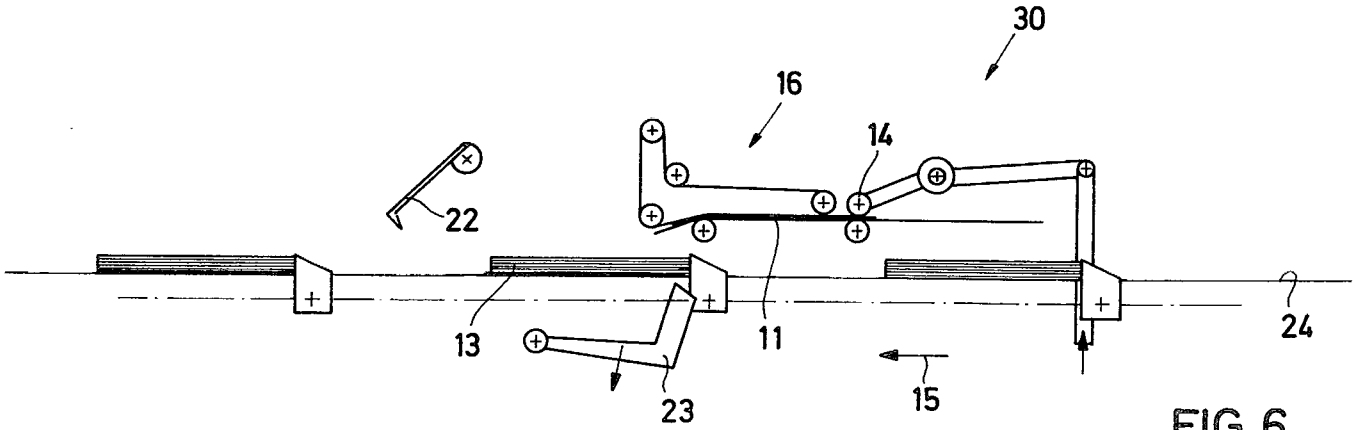

FIG. 5 shows that the stack of sheets 13 runs out via the lifting apparatus 23 and, in so doing, is raised from the conveying plane 24 to such an extent that it overlaps the end sheet 11 lying on the conveying plane.

Once the stack of sheet 13 has almost completely been pushed on to the end sheet 11, the lifting apparatus 23 is pivoted back into its inoperative position beneath the conveying plane 24 and the stop 22 pivots out when the end sheet is flush with the stack of sheets or is just before this position. In the latter case, precise orientation can be produced by a subsequent uniform pushing arrangement.

The application of the second, upper end sheet does not give rise to any problems. It is performed using a similar feed arrangement 30 either upstream or downstream of the apparatus illustrated in the drawings.

Numerous variations of the embodiment described and illustrated are possible within the scope of the invention. Thus, for example, the lifting apparatus could contain additional pivotal guide means which, particularly in the case of long formats, continue to support and carry the stack of sheets even above the end sheet and which are either lowered or pivoted out when the stack of sheet is conveyed substantially beyond the end sheet. It is also feasible to feed a plurality of end sheets, if desired, in succession or simultaneously. For example, two feed arrangements 30 may bring two end sheets, for example one top sheet and one internal title sheet, on to each other in position on the conveying plane.

It would also be possible to convey the two end sheets from opposite sides of the apparatus so that a particularly compact apparatus is provided. The conveying section can preferably run continuously.

I claim:

1. An apparatus for placing an end sheet or the like under a stack of sheets, comprising:

a conveying means for transporting said stack of sheets along a conveying direction in a substantially horizontal plane;

means for feeding said end sheet to said conveying means, said feeding means being displaced from and disposed above said conveying plane and operable to feed said end sheet in said conveying direction;

means for placing and holding said end sheet at a stationary predetermined position at least partially on said conveying means; and, means for lifting said moving stack of sheets during transport of said stack of sheets by said conveying means, said lifting means being located adjacent and upstream of said predetermined position, whereby at least a leading portion of said stack is lifted and held above said conveying means until said stack is juxtaposed above said end sheet.

2. An apparatus according to claim 1, wherein the conveying direction defines a leading edge of said end sheet, and further comprising a front stop adapted to engage the leading edge of the supplied end sheet when said end sheet is placed at least partially on the conveying means.

3. An apparatus according to claim 2, wherein said front stop is movable into and out of an operating position.

4. An apparatus for placing an end sheet or the like under a stack of sheets, comprising:

a conveying means for transporting said stack of sheets along a conveying direction in a substantially horizontal plane;

means for feeding said end sheet to said conveying means;

means for placing and holding said end sheet at a stationary predetermined position at least partially on said conveying means; and, means for lifting said moving stack of sheets during transport of said stack of sheets by said conveying means, cyclically movable into and out of engagement with successive stacks of sheets, said lifting means being located adjacent and upstream of said predetermined position, whereby at least a leading portion of said stack is lifted and held above said conveying means until said stack is juxtaposed above said end sheet.

5. An apparatus according to claim 4, wherein said lifting means has at least one oblique surface which is movable from below through said conveying plane of said conveying means.

6. An apparatus for placing an end sheet or the like under a stack of sheets, comprising:

a conveying means for transporting said stack of sheets along a conveying direction in a substantially horizontal plane, said conveying direction defining a trailing edge of said end sheet;

means for feeding said end sheet to said conveying means;

means for placing and holding said end sheet at a stationary predetermined position at least partially on said conveying means;

a pivotally mounted lever forming a rear stop engageable with said trailing edge of said end sheet; and, means for lifting said moving stack of sheets during transport of said stack of sheets by said conveying means, said lifting means being located adjacent and upstream of said predetermined postion and having at least one oblique surface which is movable from below through said conveying plane, whereby at least a leading portion of said stack is lifted and held above said conveying means until said stack is juxtaposed above said end sheet.

7. An apparatus for placing an end sheet or the like under a stack of sheets, comprising:

a conveying means for transporting said stack of sheets along a conveying direction in substantially horizontal plane, said conveying direction defining a trailing edge of said end sheet;

means for feeding said end sheet to said conveying means;

means for placing and holding said end sheet at a stationary predetermined position at least partially on said conveying means;

a pivotally mounted lever forming a rear stop for engaging said trailing edge; and, means for lifting said moving stack of sheets during transport of said stack of sheets by said conveying means, and lifting means having at least one oblique surface which is movable from below through said conveying plane, said lifting means being pivotable between an upper position wherein said oblique surface is operative and a lower inoperative position, said rear stop being pivotal in common with the lifting means, and said lifting means being located adjacent and upstream of said predetermined position, whereby at least a leading portion of said stack is juxtaposed above said end sheet.

* * * * *

UNITED STATES PATENT AND TRADEMARK OFFICE

CERTIFICATE OF CORRECTION

PATENT NO. : 4,266,761

DATED : May 12, 1981

INVENTOR(S) : HERMANN BUCK

It is certified that error appears in the above-identified patent and that said Letters Patent are hereby corrected as shown below:

At column 1, line 17, after "is normally placed on" delete "and".

At column 3, line 29, after "has been placed on" delete "to".

Signed and Sealed this

*Eighteenth* Day of *August 1981*

[SEAL]

*Attest:*

GERALD J. MOSSINGHOFF

*Attesting Officer*

*Commissioner of Patents and Trademarks*